United States Patent [19]

Chilton

[11] 4,196,610

[45] Apr. 8, 1980

[54] CONDUIT BENDER

[75] Inventor: Gerald E. Chilton, College Place, Wash.

[73] Assignee: Richard W. Hensel, College Place, Wash.

[21] Appl. No.: 957,405

[22] Filed: Nov. 3, 1978

[51] Int. Cl.[2] ..... B21D 7/02

[52] U.S. Cl. ..... 72/459; 81/177 PP; 403/97; 403/359

[58] Field of Search ..... 72/459, 458, 457, 319; 81/177 PP; 403/97, 359, 407, 408

[56] References Cited

U.S. PATENT DOCUMENTS

| | | | |
|---|---|---|---|
| 117,623 | 8/1871 | Hamler | 403/97 |
| 1,247,729 | 11/1917 | Scribner | 72/459 |
| 1,800,349 | 4/1931 | Hurason | 403/97 |
| 2,349,525 | 5/1944 | St. Clair | 72/459 |
| 2,555,226 | 5/1951 | Draughn | 403/97 |
| 2,571,241 | 10/1951 | Henderson | 72/458 |
| 2,816,672 | 12/1957 | Facchini | 403/97 |
| 2,908,193 | 10/1959 | Gryniewicz | 72/459 |
| 3,194,038 | 7/1965 | Small | 72/459 |
| 3,757,560 | 9/1973 | Hargash | 72/458 |
| 3,906,778 | 9/1975 | Crouse | 72/459 |

FOREIGN PATENT DOCUMENTS

| | | | |
|---|---|---|---|
| 531991 | 10/1956 | Canada | 72/458 |
| 233231 | 10/1944 | Switzerland | 72/458 |
| 359459 | 10/1931 | United Kingdom | 403/97 |

*Primary Examiner*—Francis S. Husar
*Assistant Examiner*—Gene P. Crosby
*Attorney, Agent, or Firm*—Wells, St. John & Roberts

[57] ABSTRACT

A device that enables selective angular positioning of the handle of a conduit bender. The device includes two opposed mounting members having serrated surfaces. They are releasably joined so that one may be selectively pivoted about an axis relative to the other. One member is operatively connected to a conduit bender handle while the other member is connected to the rigid body of the conduit bender. An offset provision is made between the handle and an adjacent mounting member. The handle can therefore be removed and located adjacent either side of the rigid body while remaining pivotal in a 360° arc about the axis. A threaded member may be tightened to lock the members together.

10 Claims, 6 Drawing Figures

CONDUIT BENDER

BACKGROUND OF THE INVENTION

The present invention is related to conduit benders and attachments for conduit benders that will allow adjustment of the position of the handle relative to the rigid body of the conduit bender.

Conduit benders are utilized by electricians and plumbers for producing bends in thin wall conduits which are formed usually of copper or aluminum alloy. Another form of conduit bender, termed a "hickey," is also utilized for bending rigid conduit of heavier construction.

In using a conduit bender, the rigid body of the bender is placed adjacent to a conduit at the desired location for the bend. The bender includes a concave and arcuate conduit-receiving channel about which the conduit is bent. At one end of the channel is an oppositely facing conduit hook. This hook is placed around the conduit at the bend area and the arcuate channel is placed against the conduit. The handle is then operated as a lever against the engaged portion of the conduit. The conduit will bend in an arc in conformity to the arcuate configuration of the channel. This process is usually accomplished on a flat surface before the conduit is installed. However, in many instances it is desirable to first install the conduit and then perform the bends necessary to route the conduit to a desired location.

The conventional conduit bender simply has a rigid handle extending outward from the center of its rigid conduit bender body. The handle is often in the way of adjacent walls or equipment and makes it impossible to produce bends accurately to confrom to walls, ceilings, or other contours along which the conduit is to be placed. This is particularly true in situations where it is desirable to bend the conduit as it is being installed rather than prebending it prior to installation.

It therefore becomes desirable to obtain a conduit bender with provisions that allow pivoted movement of its handle relative to the rigid bender body so the device can be operated in close quarters.

DETAILED DESCRIPTION OF A PREFERRED AND ALTERNATE EMBODIMENT

Figure 1:
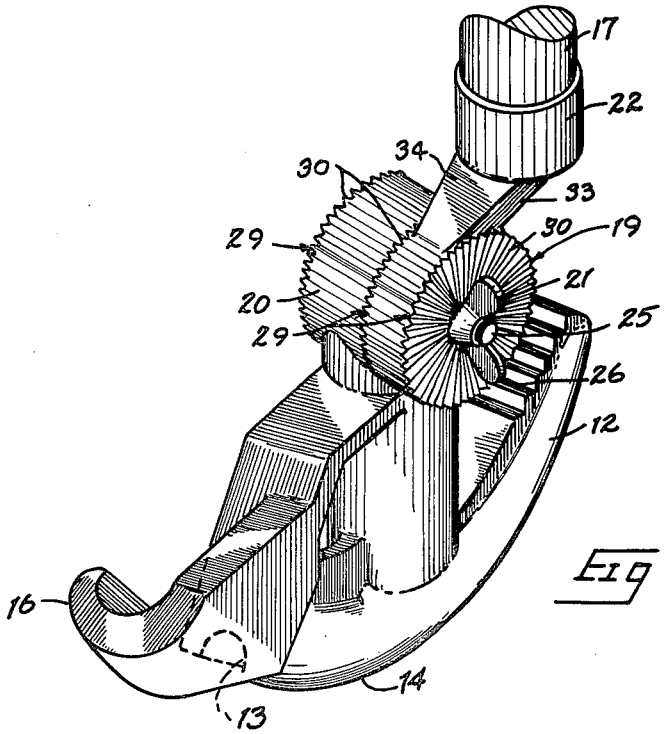
FIG. 1 is a pictorial view of a first embodiment of the present conduit bender.
Figure 2:
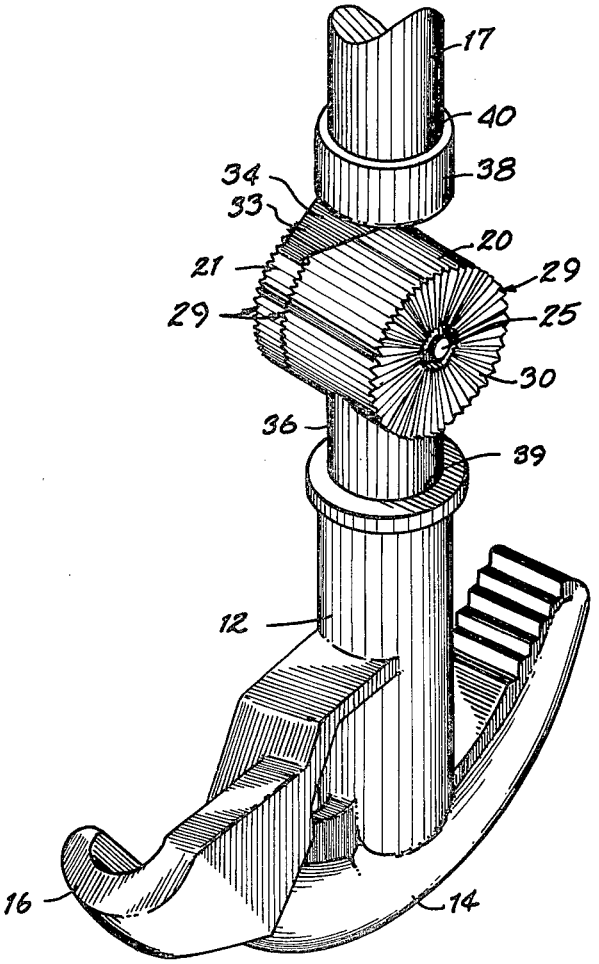
FIG. 2 is a pictorial view of a second embodiment of the present invention.

FIG. 1 illustrates a conduit bender of a preferred form which is generally designated by the reference character 10. FIG. 2 illustrates an embodiment of my invention as an attachment 10*a* to mount a rigid conduit bender body to a handle.

A rigid body 12 is provided at the lower end of both forms of the present invention. The body may be in the form as illustrated or may take the form of other known forms of conduit bending apparatus such as the conventionally available "hickey." Generally speaking, the rigid body 12 includes an elongated arcuate channel 13 (FIG. 1) that is formed along an elongated arcuate axis. The channel is concave and faces outwardly at a bottom side 14 of rigid body 12. The channel is typically formed on a radius that is equal to the desired radius of curvature for the conduit being bent.

A conduit hook 16 is provided at one end of channel 13. It is formed within a recess in the body 12 and faces opposite to the channel 13. The recess of conduit hook 16 and the concave configuration of channel 13 are complementary to the circular cross section of the conduit to be bent.

A handle member 17 is also common to both embodiments. The handle member extends outwardly from the rigid body 12. It is generally a length of standard pipe which is threaded at one end to be received by the rigid body 12.

Reference will now be made to the specific elements relating to the embodiment illustrated in FIG. 1.

The conduit bender 10 of FIG. 1 includes means 19 between the handle member 17 and rigid body 12 for allowing adjustable pivotal movement of the handle member along either side of the rigid body about a 360° arc. It includes a first mounting member 20 that is formed integrally with the rigid body 12 and a second mounting member 21 located at a lower end of the handle member 17. Second mounting member 21 includes a socket 22 for receiving an end of handle member 17.

Means provided for releasably connecting the first and second mounting members 20 and 21 for pivotal movement about the 360° arc may include a threaded shank 25. Shank 25 extends through aligned apertures 27 (FIG. 5) in both members 20 and 21. An end of the shank 25 includes a wing nut 26. The opposite shank end includes a bolt head or nut 28 that is fitted within a complementary recess 28*a*. Nut 26 may be selectively tightened to secure the mounting members together and therefore inhibit pivotal movement of the members relative to one another about the axis of bolt 25. The shank 25 defines a pivot axis that is perpendicular to a plane passing through the channel axis and to the axis of handle member 17.

A locking means 29 is associated with the first and second mounting members for locking the handle member in a selected angular position about the shank axis. Locking means 29 may include a set of serrations 30 on opposed pairs of matching surfaces of the mounting members 20 and 21. These serrations are arranged radially about the axis of shank 25 and will interfit and lock the members against pivotal movement about the axis when the wing nut 26 is secured to bring oppositely facing serrations of the members into engagement.

The serrations 30 are provided on opposite surfaces of the mounting members to allow selective positioning of the members against one another for the purpose of changing the position of handle member 17 relative to the rigid body 12.

Figures 4, 5, 6:
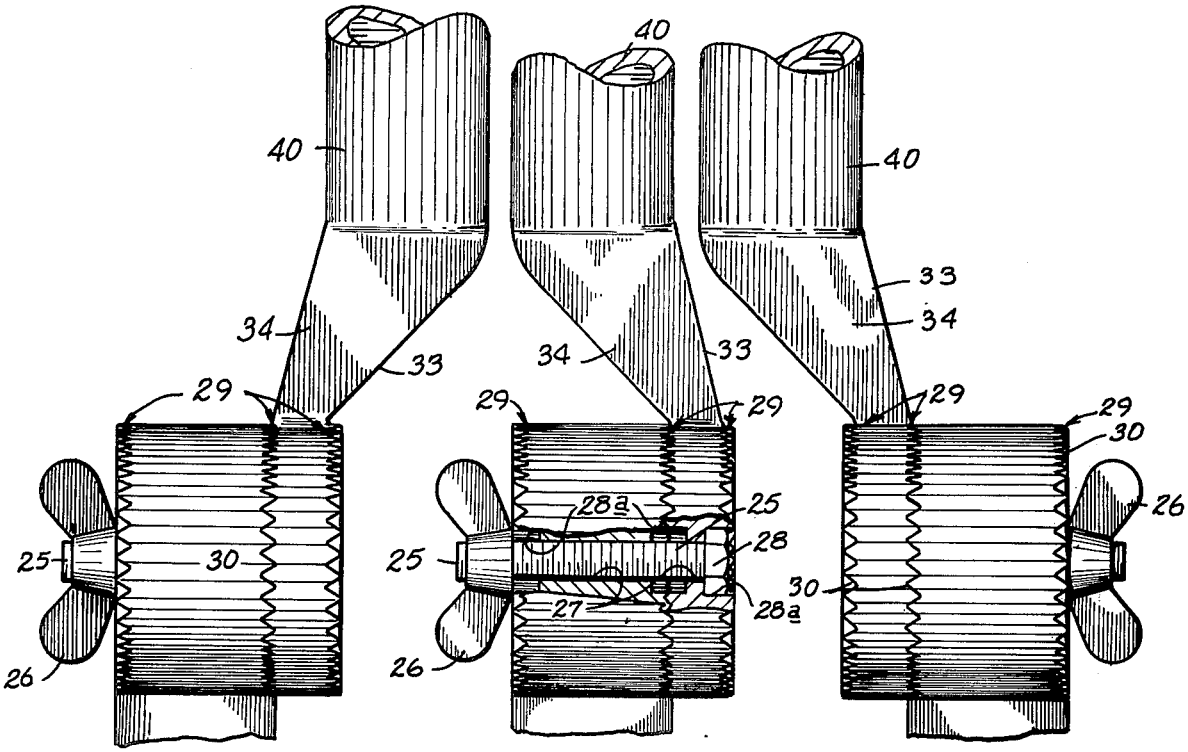
FIG. 4 is a fragmentary view illustrating elements of the present invention in one position.
FIG. 5 is a view similar to FIG. 3, showing a different operational position.
FIG. 6 is a view similar to FIGS. 3 and 4, showing a third operational position.

An offset means 33 is associated between the socket 22 and mounting and mounting member 21 for displacing handle member 17 to one selected side of the rigid body 12. It also allows the handle member to be aligned along the center of the channel axis as illustrated in FIG. 5.

Figure 3:
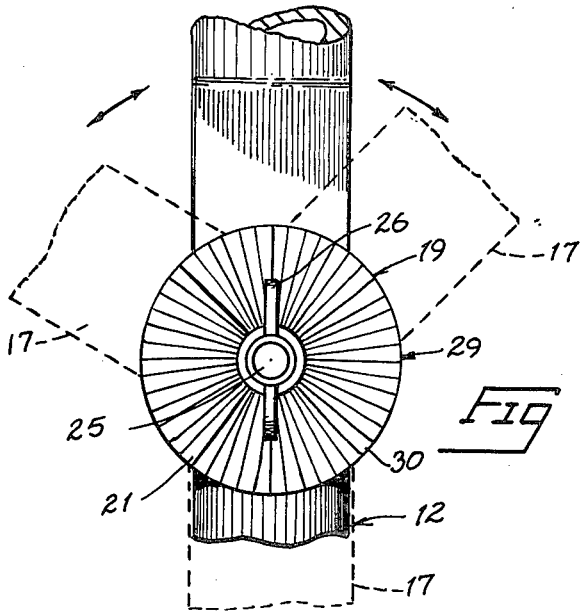
FIG. 3 is a fragmentary side view as seen from the right in FIG. 1.

Offset means 33 may be provided in the form of an inclined rib 34 extending between the socket 22 and mounting member 21. The angle of inclination is such that the handle member 17 may be secured within the socket 22 and pivoted about the axis of carriage bolt 25 without coming into contact with the rigid body 12. Rib 34 is best illustrated in FIGS. 3 through 5. In FIG. 3 the rib 34 is positioned so that the handle is displaced along one side of the rigid body. In FIG. 4 the rib is poitioned so the handle is displaced along the opposite side of rigid body 12, and in FIG. 5, the rib 34 extends inwardly over the first mounting member 20 to position the handle in planar alignment with the axis of channel 13.

The embodiment of my invention illustrated in FIG. 2 includes elements similar to those disclosed above except that it is utilized as an intermediate attachment for joining a handle member 17 to a conventional form of the rigid body 12. To this end, it includes the additional provisions of an attachment mounting member 36 in the form of a plug that may be received within a socket 39 of a standard form of rigid conduit bender body 12. A handle receiving and mounting member 38 in the form of a socket 40 is provided in connection with the second mounting member 21. An inclined rib 34 angularly joins the socket 40 with the second mounting member 21 to laterally offset socket 40, which is arranged parallel to member 36. The first mounting member 20 can be integral with the attachment mounting member 36. It can also be removably mounted to member 36. In the latter instance, member 36 may be provided in the form of a short section of pipe (not shown) threaded to interconnect member 20 and body 12.

The attachment illustrated in FIG. 2 may be fitted to an existing form of rigid conduit bender body 12 simply by inserting the attachment mounting member 36 in the existing handle receiving socket 39 of the body. The handle member 17 may then be received within the socket 40 attached to the second mounting member 21. Adjustment of the handle relative to the rigid body is then affected in the same manner as described above.

It may be noted that each surface of the mounting members 20, 21 includes a recess 28*a* for receiving the bolt head or nut 28. This feature enables selective positioning of the nut 28 and wing nut 26 to either side of the members as demonstrated by comparing FIGS. 5 and 6. The wing nut 26 will not obstruct operation of the bender.

FIG. 3 is illustrative of several different handle positions attainable about the axis of shank 25. The angular relationship of the handle 17 to rigid body 12 is shown with the handle in dashed lines. Depending on the installation, the handle 17 may be pivoted anywhere in a 360° arc about the shank axis to place the conduit channel and handle in an operative position relative to a conduit. The offsetting means allows selective positioning of the handle to the center or to either side of the body 12 to further facilitate operation.

The above description and attached drawings are given by way of example to describe a preferred and alternate form of the present invention. They are not intended to limit the scope of my invention which is set forth only by the following claims.

What I claim is:

1. A conduit bender, comprising:
a rigid body;
a conduit receiving channel formed in said body along a channel axis at a bottom side thereof;
a conduit hook at one end of said channel being formed of a recess within said body in alignment with and facing opposite to said conduit receiving channel;
a handle member;
a first mounting member on the body;
a second mounting member on the handle member;
means for releasably joining the first and second mounting members for pivotal movement to any selected angular position about a pivot axis that is perpendicular to the channel axis;
handle offsetting means between the handle member and second mounting member for positioning the handle member at a selected position in alignment with the channel axis or at a selected position spaced to one side of the channel axis and clear of said rigid body; and
locking means associated with the first and second mounting members for locking the handle member in a selected angular position.

2. the conduit bender as defined by claim 1 wherein said locking means is comprised of matching serrated surfaces on the first and second mounting members.

3. The conduit bender as defined by claim 1 wherein said handle offsetting means is comprised of an angularly inclined rib member on the handle member extending angularly from the handle member to the second mounting member.

4. A conduit bender, comprising:
a rigid body;
a conduit receiving channel formed in said body along a channel axis at a bottom side thereof;
a conduit hook at one end of said channel being formed of a recess within said body in alignment with and facing oppositely to said conduit receiving channel;
a handle member;
means between the handle member and rigid body for allowing adjustable pivotal movement of the handle member along one side of the rigid body about a 360° radius and for selectively positioning the handle member in alignment with the conduit receiving channel or at a selected position offset to one side thereof and clear of said rigid body; and
locking means for securing the handle member at any selected angular position about the 360° radius.

5. The conduit bender as defined by claim 4 wherein said means between the handle member and rigid body includes:
a rib member extending angularly from said handle member;
a first mounting member on said rib member;
a second mounting member on said rigid body;
matching surfaces on the mounting members for frictionally engaging one another; and
interconnecting said mounting members at the center of the 360° arc to define a pivot axis about which the handle member and rigid body may be selectively pivoted.

6. The conduit bender as defined by claim 5 wherein said locking means is comprised of matching serrations on said matching surfaces of said mounting members formed radially about the pivot axis.

7. An attachment for mounting a conduit bender handle to a conduit bender for selective positioning of the handle about a 360° arc relative to the conduit bender, said attachment comprising:

an attachment mounting member adapted to be received by and secured to a conduit bender;

a conduit bender handle receiving member adapted to receive and mount a conduit bender handle;

means interconnecting the attachment mounting member and conduit bender handle receiving member for allowing adjustable pivotal movement of the conduit bender handle receiving member relative to the attachment mounting member through a 360° arc and for selectively positioning the conduit bender handle receiving member in alignment with the attachment mounting member or offset to the side thereof;

locking means for securing the handle member at any selected angular position about the 360° arc; and said interconnecting means including handle offset means associated with the conduit bender handle receiving member for selectively displacing said conduit bender handle receiving member to the side of said attachment mounting member.

8. The attachment as defined by claim 7 wherein the attachment mounting member is comprised of a plug adapted to be frictionally secured to a conduit bender and wherein the conduit blender handle receiving member is comprised of a socket adapted to receive and frictionally secure a conduit bender handle to the attachment, said socket being laterally offset and parallel to said plug by an intermediate inclined rib.

9. The attachment as defined by claim 8 wherein the means interconnecting said attachment mounting member and said conduit bender handle receiving member is comprised of:

a first disc on the conduit bender handle receiving member;

a second disc on the attachment mounting member;

matching surfaces on the first and second discs for frictional engagement with one another; and pivot pin means interconnecting said discs at the center of the 360° arc and defining a pivot axis about which the conduit bender handle receiving member and attachment mounting member respectively pivot.

10. The attachment as defined by claim 9 wherein said locking means is comprised of matching serrations on said matching surfaces of said mounting members formed radially about the pivot axis.

* * * * *